US010877399B2

(12) United States Patent
Matsuda et al.

(10) Patent No.: US 10,877,399 B2
(45) Date of Patent: Dec. 29, 2020

(54) STIRRING DEVICE WITH A LUBRICATING LAYER, TONER CONTAINER, WASTE TONER RECEPTACLE, AND IMAGE FORMING APPARATUS

(71) Applicants: Naoki Matsuda, Kanagawa (JP); Masahiro Ishida, Kanagawa (JP)

(72) Inventors: Naoki Matsuda, Kanagawa (JP); Masahiro Ishida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/590,547

(22) Filed: Oct. 2, 2019

(65) Prior Publication Data

US 2020/0125006 A1 Apr. 23, 2020

(30) Foreign Application Priority Data

Oct. 17, 2018 (JP) ..... 2018-195582
Sep. 27, 2019 (JP) ..... 2019-177827

(51) Int. Cl.
*G03G 15/08* (2006.01)

(52) U.S. Cl.
CPC ..... *G03G 15/0889* (2013.01); *G03G 15/0896* (2013.01); *G03G 15/0875* (2013.01); *G03G 2215/068* (2013.01); *G03G 2215/0802* (2013.01); *G03G 2215/085* (2013.01); *G03G 2215/0816* (2013.01); *G03G 2215/0819* (2013.01)

(58) Field of Classification Search
CPC ..... G03G 15/0889; G03G 15/0865; G03G 15/0867; G03G 15/0868; G03G 15/0875; G03G 15/0887; G03G 15/0896; G03G 15/104; G03G 2215/066; G03G 2215/068; G03G 2215/0685; G03G 2215/0802; G03G 2215/0816; G03G 2215/0819; G03G 2215/0836; G03G 2215/085; G03G 2215/0852; G03G 21/10; G03G 21/12
See application file for complete search history.

(56) References Cited

U.S. PATENT DOCUMENTS 5,870,652 A * 2/1999 Kanamori ..... G03G 15/0822 399/106
6,173,130 B1 * 1/2001 Oguma ..... G03G 15/0822 399/254
6,421,517 B1 * 7/2002 Nishino ..... G03G 15/0875 399/254
2011/0176820 A1 * 7/2011 Kadota ..... G03G 15/0849 399/44

(Continued)

FOREIGN PATENT DOCUMENTS

JP 2010-054678 3/2010
JP 2014-174538 9/2014

*Primary Examiner* — Walter L Lindsay, Jr.
*Assistant Examiner* — Laura Roth
(74) *Attorney, Agent, or Firm* — Harness, Dickey & Pierce, P.L.C.

(57) ABSTRACT

A stirring device includes a stirrer configured to stir a stirred object, at least another component of the stirring device, and a coating layer. The coating layer is disposed on at least one of a contact part of the stirrer that contacts the at least another component and a contacted part of the at least another component contacted by the stirrer.

17 Claims, 14 Drawing Sheets

(56) References Cited

U.S. PATENT DOCUMENTS

| | | | | |
|---|---|---|---|---|
| 2013/0266330 | A1* | 10/2013 | Monde | G03G 15/086 399/27 |
| 2015/0301496 | A1* | 10/2015 | Kawashima | G03G 21/105 399/358 |
| 2016/0170361 | A1 | 6/2016 | Matsuda et al. | |
| 2016/0221772 | A1 | 8/2016 | Ishida et al. | |
| 2017/0057767 | A1 | 3/2017 | Ishida et al. | |
| 2018/0099828 | A1 | 4/2018 | Ishida et al. | |
| 2018/0231921 | A1* | 8/2018 | Leemhuis | G03G 15/0865 |
| 2018/0297802 | A1* | 10/2018 | Ishida | B65H 5/36 |

* cited by examiner

STIRRING DEVICE WITH A LUBRICATING LAYER, TONER CONTAINER, WASTE TONER RECEPTACLE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2018-195582, filed on Oct. 17, 2018 and 2019-177827, filed on Sep. 27, 2019, in the Japan Patent Office, the entire disclosure of each of which is hereby incorporated by reference herein.

BACKGROUND

Technical Field

Embodiments of the present disclosure generally relate to a stirring device, a toner container, a waste toner receptacle, and an image forming apparatus.

Description of the Related Art

There are stirring devices including a stirrer configured to stir a stirred object.

SUMMARY

Embodiments of the present disclosure describe an improved stirring device that includes a stirrer configured to stir a stirred object, at least another component of the stirring device, and a coating layer. The coating layer is disposed on at least one of a contact part of the stirrer that contacts the at least another component and a contacted part of the at least another component contacted by the stirrer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
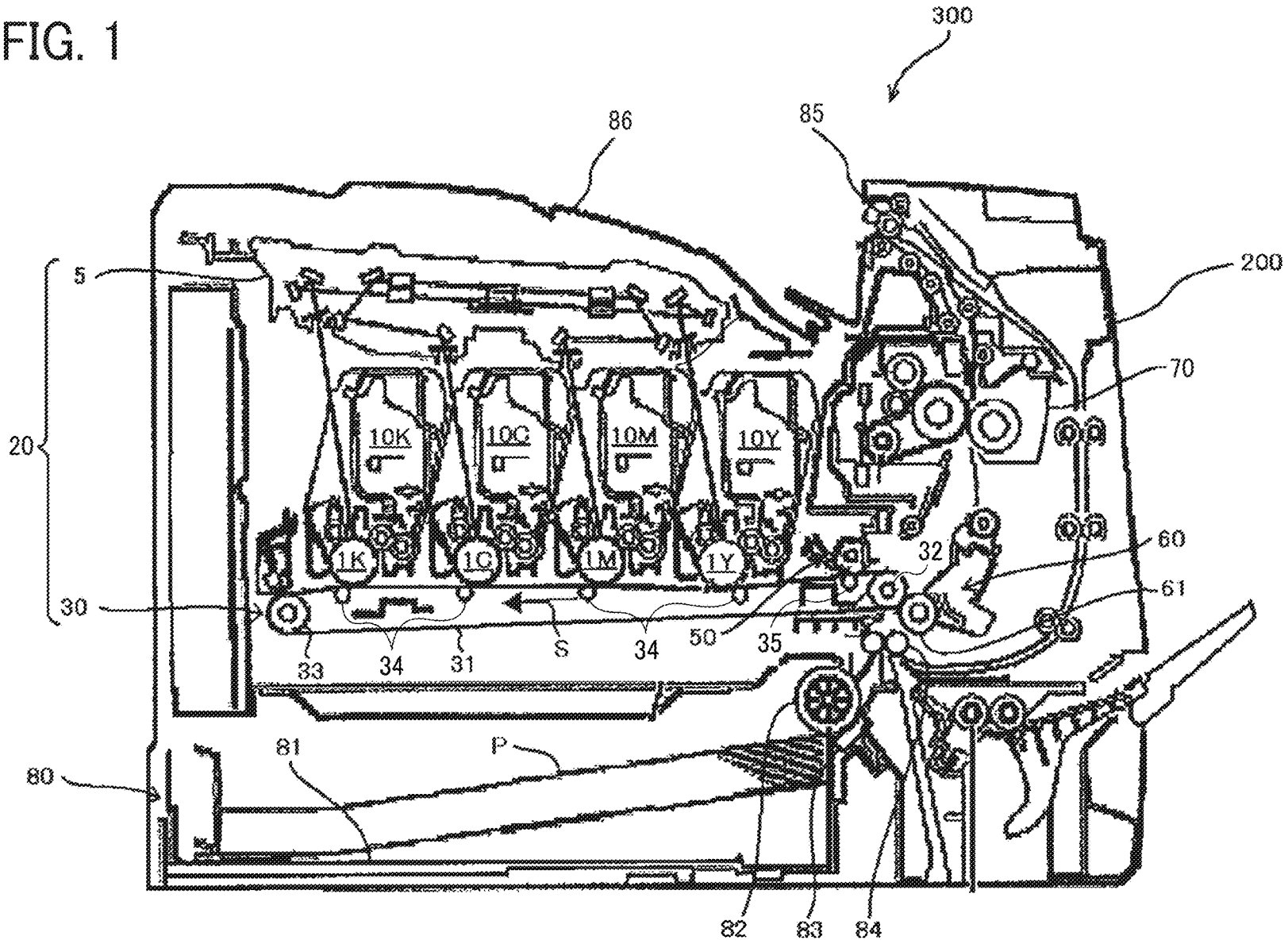
FIG. 1 is a schematic view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

An electrophotographic multicolor laser printer (hereinafter, simply referred to as "printer 300") is described below as an example of an image forming apparatus according to an embodiment of the present disclosure (hereinafter, also referred to as "first embodiment"). A configuration and operation of the printer 300 are described below. In the first embodiment, the printer 300 is described. However, the present disclosure is not limited to the printer 300, but can be applied to copiers, facsimile machines, printing presses, or multifunction peripherals having at least two of these capabilities as image forming apparatuses.

Figure 2:
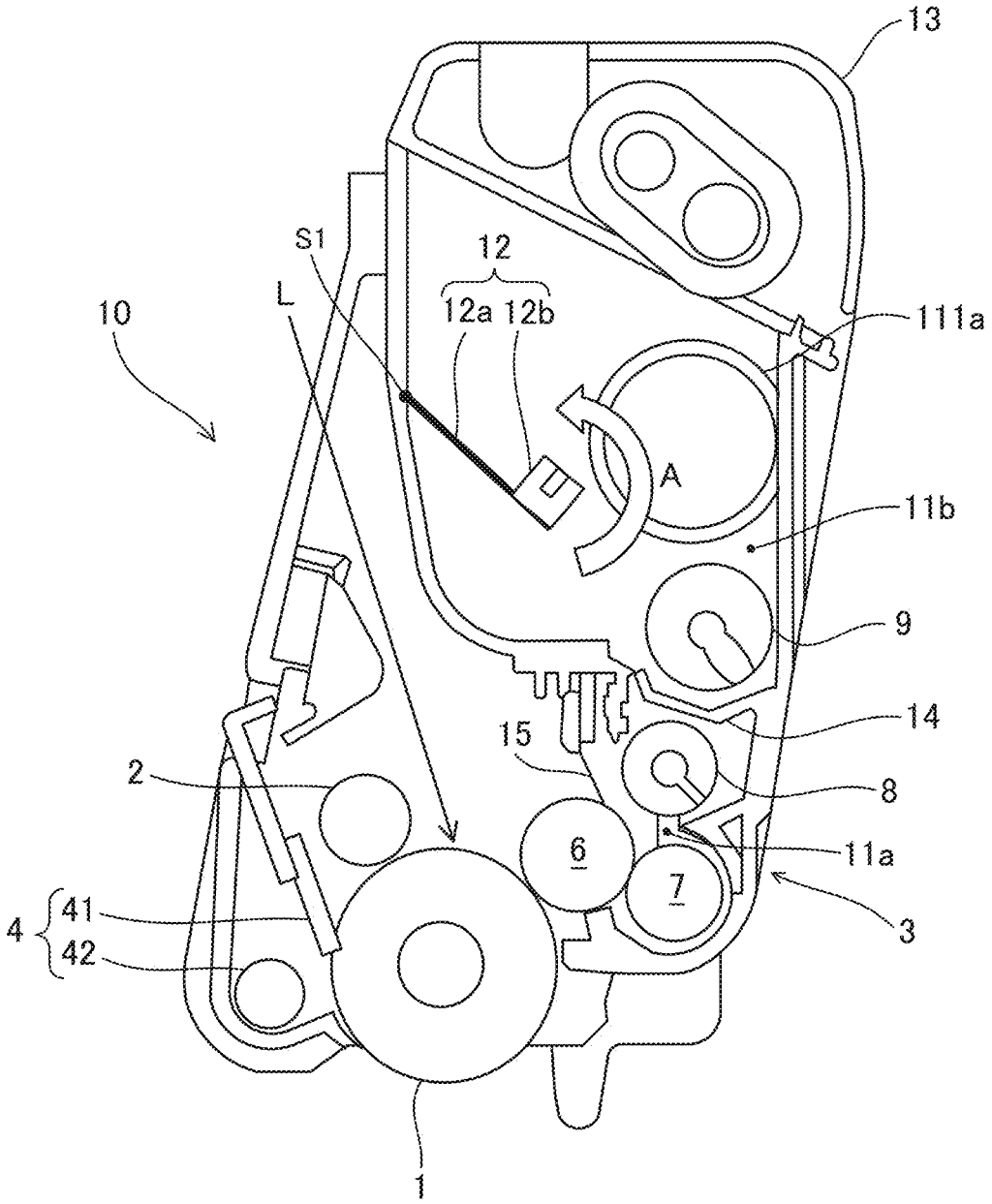
FIG. 2 is a schematic view of an image forming unit according to the first embodiment of the present disclosure.

FIG. 1 is a schematic view of the printer 300 according to the first embodiment, and FIG. 2 is a schematic view of an image forming unit 10 according to the first embodiment.

The printer 300 in the present embodiment is the multicolor laser printer employing a tandem system using four color toners, that is, yellow (Y), magenta (M), cyan (C), and black (K) toners. As illustrated in FIG. 1, a sheet feeding device 80 including a sheet tray 81 to store recording media such as recording papers (hereinafter, referred to as "sheets P") is disposed at the bottom portion of an apparatus body 200 of the printer 300. An image forming device 20 is disposed above the sheet feeding device 80.

A configuration and operation of each device are described below.

The image forming device 20 includes an intermediate transfer unit 30 including an intermediate transfer belt 31 and image forming units 10Y, 10M, 10C, and 10K disposed above the intermediate transfer unit 30. The image forming units 10Y, 10M, 10C, and 10K corresponding to the respective colors are arranged in the order of Y, M, C, and K from the right in FIG. 1 along the intermediate transfer belt 31 stretched taut in the horizontal direction. The image forming device 20 further includes a scanner (optical writing device) 5 disposed above the image forming units 10Y, 10M, 10C, and 10K. A secondary transfer device 60 is disposed on the right side of the intermediate transfer unit 30 in FIG. 1, and a fixing device 70 is disposed above the secondary transfer device 60.

The image forming units 10Y, 10M, 10C, and 10K include photoconductor drums 1Y, 1M, 1C, and 1K serving as latent image bearers, respectively. Each of the image forming units 10Y, 10M, 10C, and 10K further includes a charging roller 2, a developing device 3, a cleaning device 4 for each of the photoconductor drums 1Y, 1M, 1C, and 1K, in a housing of a process cartridge (see FIG. 2). The image forming units 10Y, 10M, 10C, and 10K have a similar configuration except the color of toner used therein, and hereinafter the suffixes Y, M, C, and K are omitted when color discrimination is not necessary.

As illustrated in FIG. 2, the image forming unit 10 includes the photoconductor drum 1, the charging roller 2 as a charging device that contacts a surface of the photoconductor drum 1 to uniformly charge the surface of the photoconductor drum 1, and the developing device 3 including a developing roller 6 as a developer bearer. The image forming unit 10 further includes the cleaning device 4 including a cleaning blade 41 that contacts the surface of the photoconductor drum 1.

When the image forming operation starts, the charging roller 2 uniformly charges the surface of the photoconductor drum 1 rotating clockwise in FIG. 2 in the dark (initializing with high potential). Then, the photoconductor drum 1 is irradiated with a laser beam L based on image data by the scanner 5. An electrostatic latent image is formed that includes a low potential portion where the surface potential of the photoconductor drum 1 has been decayed by the exposure with the laser beam L and a high potential portion due to uniform charging. As the photoconductor drum 1 rotates, the developing device 3 develops the electrostatic latent image into a toner image (a visible image). Specifically, a supply roller 7 supplies a developer to the developing roller 6, and toner in the developer carried on the developing roller 6 is transferred to the low potential portion (or the high potential portion) of the electrostatic latent image to visualize the electrostatic latent image. As the photoconductor drum 1 rotates, the toner image is transported to a primary transfer position where the photoconductor drum 1 is opposed to the intermediate transfer belt 31 of the intermediate transfer unit 30. The toner image is transferred to the intermediate transfer belt 31 by a primary transfer bias applied to each of the primary transfer rollers 34 opposed to the photoconductor drums 1Y, 1M, 1C, and 1K via the intermediate transfer belt 31.

The cleaning blade 41 of the cleaning device 4 is disposed downstream from the primary transfer position in the direction of rotation of the photoconductor drum 1 and in contact with the surface of the photoconductor drum 1. Residual toner remaining on the photoconductor drum 1 after the primary transfer process is scraped off by the cleaning blade 41. A conveying screw 42 of the cleaning device 4 transports the residual toner scraped off by the cleaning blade 41 as waste toner to a waste toner receptacle 13.

As illustrated in FIG. 1, the electrostatic latent images and the toner images by development process are sequentially formed at the timing set in the respective image forming units 10Y, 10M, 10C, and 10K. An upper stretched surface of the intermediate transfer belt 31 travels in the direction indicated by arrow S (to the left in FIG. 1). The respective single-color toner images on the photoconductor drums 1Y, 1M, 1C, and 1K are primarily transferred to and superimposed on the intermediate transfer belt 31, thereby forming a multicolor toner image on the intermediate transfer belt 31.

The intermediate transfer unit 30 includes the intermediate transfer belt 31 to carry toner images, a drive roller 32, and a tension roller 33. The drive roller 32 and the tension roller 33 are disposed inside the loop of the intermediate transfer belt 31 and stretch the intermediate transfer belt 31 at both ends of the intermediate transfer unit 30. As described above, the intermediate transfer belt 31 is mainly stretched by the two rollers of the drive roller 32 and the tension roller 33. Thereby, the size of the intermediate transfer unit 30 is reduced. The intermediate transfer unit 30 further includes the primary transfer rollers 34 and a cleaning backup roller 35 inside the loop of the intermediate transfer belt 31. The primary transfer rollers 34 are made of metal and opposed to the photoconductor drums 1M, 1C, and 1K, respectively, via the intermediate transfer belt 31.

The intermediate transfer unit 30 further includes holders that rotatable hold the above-described rollers at both ends. The intermediate transfer belt 31 is driven to rotate by the rotation of the drive roller 32 in a state in which the tension is applied to the intermediate transfer belt 31 by the tension roller 33. The intermediate transfer belt 31 is made of a heat-resistant material such as polyimide, polyimide, polycarbonate, thermoplastic elastomer (TPE), or the like and is an endless belt including a substrate adjusted to moderate resistivity.

A belt cleaning device 50 is disposed on the outer circumference of the intermediate transfer belt 31 downstream from the secondary transfer device 60 in the direction of rotation of the intermediate transfer belt 31. The belt cleaning device 50 removes residual toner remaining on the surface of the intermediate transfer belt 31 after the toner image is transferred therefrom onto the sheet P. That is, the belt cleaning device 50 is disposed on the upper stretched surface of the intermediate transfer belt 31 stretched by the drive roller 32 and the tension roller 33, downstream from the drive roller 32, and upstream from the image forming unit 10Y in the direction of rotation of the intermediate transfer belt 31.

The multicolor toner image on the intermediate transfer belt 31 is transferred onto the sheet P transported from the sheet feeding device 80, by the secondary transfer device 60. More specifically, the sheets P picked up by a sheet feeding roller 82 from the sheet tray 81 in the sheet feeding device 80 illustrated in FIG. 1 are separated by a friction pad 83 one by one. Then, the separated sheet P is transported to a secondary transfer position, where a secondary transfer roller 61 of the secondary transfer device 60 is opposed to the drive roller 32 via the intermediate transfer belt 31, by a registration roller pair 84. The registration roller pair 84 transports the sheet P, timed to coincide with the arrival f the multicolor toner image on the intermediate transfer belt 31. Then, the multicolor toner image on the intermediate transfer belt 31 is transferred onto the sheet P at the secondary transfer position. The residual toner remaining on the intermediate transfer belt 31 after the secondary transfer process is removed by the belt cleaning device 50 disposed downstream from the drive roller 32 in the direction of rotation of the intermediate transfer belt 31, and the intermediate transfer belt 31 is prepared for subsequent toner image transfer.

The belt cleaning device 50 includes a belt cleaning blade opposite the cleaning backup roller 35 via the intermediate transfer belt 31. The belt cleaning blade scrapes off the residual toner on the intermediate transfer belt 31. The residual toner scraped off from the intermediate transfer belt 31 by the belt cleaning blade is transported to a waste toner container disposed, for example, below the intermediate transfer unit 30, and becomes waste toner.

The multicolor toner image is transferred onto the sheet P at the secondary transfer position. The sheet P carrying the multicolor image is transported along a sheet conveyance path to the fixing device 70. The fixing device 70 fixes the multicolor toner image on the sheet P, and the sheet P is ejected onto an output tray 86 by an output roller pair 85. Thus, a sequence of image forming processes performed on the photoconductor drum 1 is completed, and the photoconductor drum 1 is prepared for subsequent image formation.

Next, the image forming unit 10 is described in detail.

Figure 3:
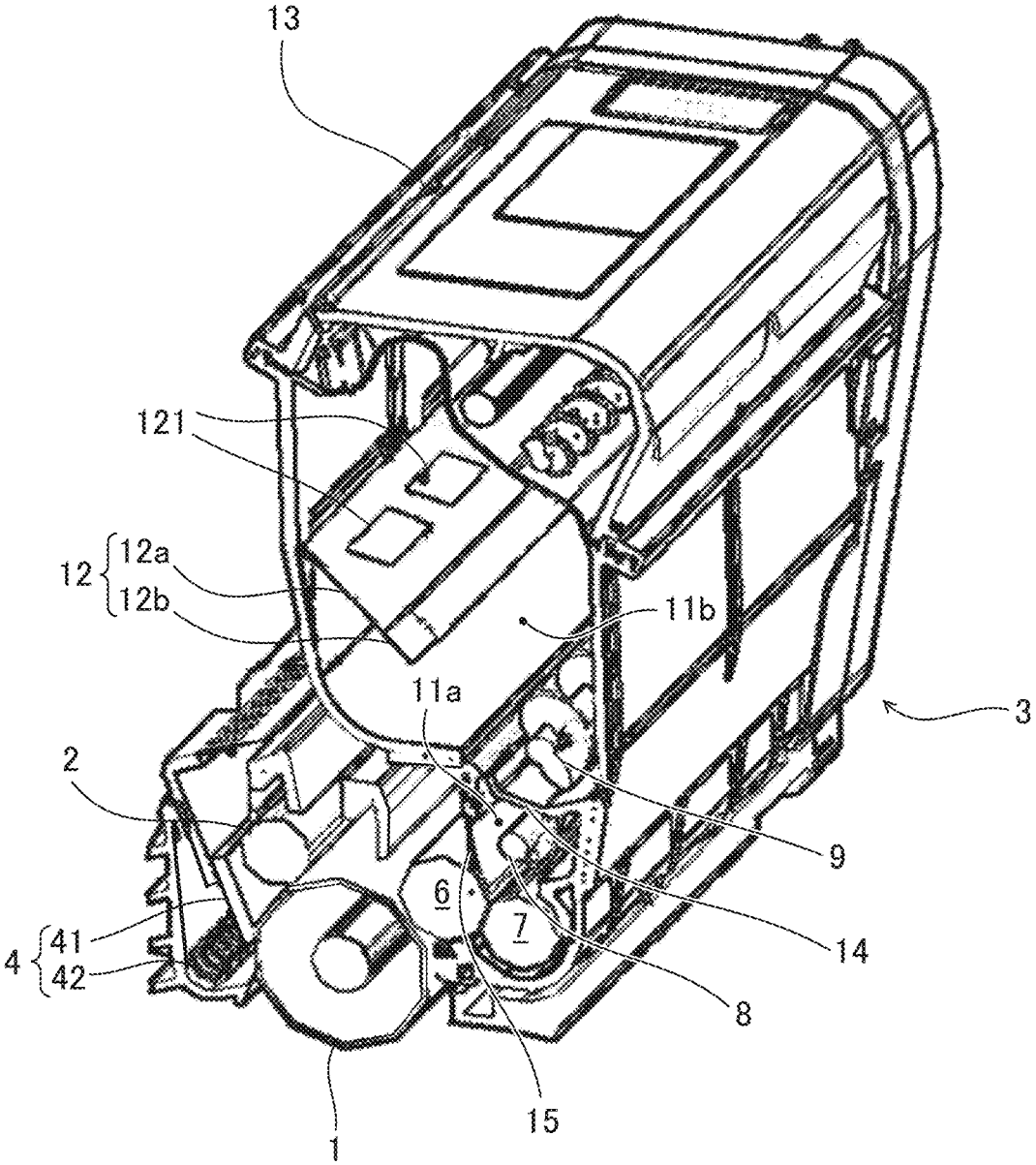
FIG. 3 is a cross-sectional perspective view of the image forming unit in FIG. 2.
Figure 4:
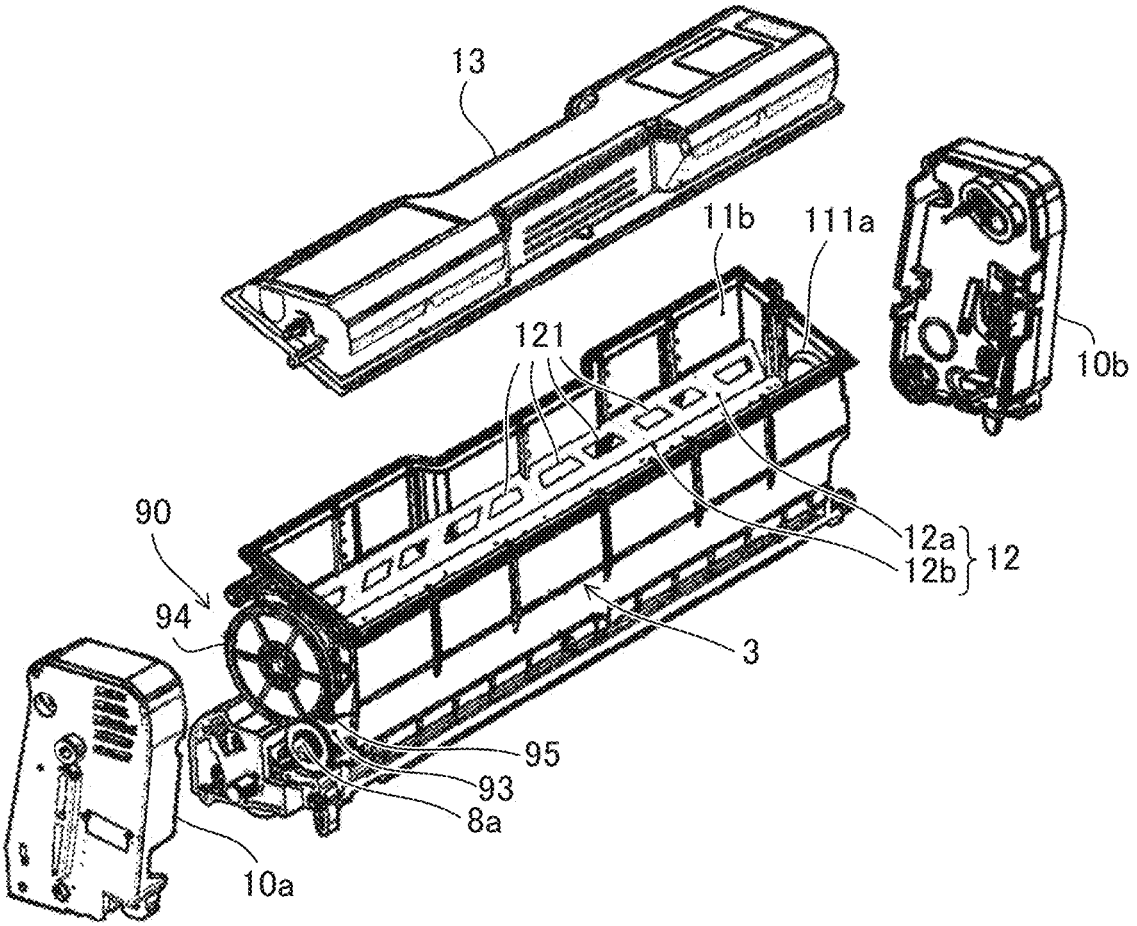
FIG. 4 is an exploded perspective view of the image forming unit in FIG. 2.

FIG. 3 is a cross-sectional perspective view of the image forming unit 10, and FIG. 4 is an exploded perspective view of the image forming unit 10.

The image forming unit 10 includes the photoconductor drum 1, the charging roller 2 as the charging device in contact with the surface of the photoconductor drum 1 to uniformly charge the surface of the photoconductor drum 1, and the developing device 3 including a developing roller 6 as a developer bearer. The image forming unit 10 further includes the cleaning device 4 including the cleaning blade 41 that contacts the surface of the photoconductor drum 1 and the conveying screw 42 that transports the removed residual toner from the photoconductor drum 1 by the cleaning blade 41 to the waste toner receptacle 13. The image forming unit 10 is installable in and removable from the apparatus body 200 of the printer 300 so that expendable parts can be replaced at one time.

The developing device 3 includes a development section 11*a* and a hopper 11*b* as a container having a vertically long shape to contain toner. A partition wall 14 is disposed between the hopper 11*b* and the development section 11*a* to partition the hopper 11*b* and the development section 11*a*. The partition wall 14 is provided with a communication hole that allows the hopper 11*b* and the development section 11*a* to communicate with each other.

The developing roller 6, the supply roller 7, a first conveying screw 8 as a first conveyor, and a toner layer regulator (development blade) 15 are disposed in the development section 11*a*. The supply roller 7 slidingly contacts the developing roller 6 to supply one-component toner to the developing roller 6. The first conveying screw 8 stirs the toner and supplies the toner to the supply roller 7. The toner layer regulator (development blade) 15 is in contact with the developing roller 6 to thin the toner layer on the developing roller 6 to a certain thickness.

A second conveying screw 9 as a second conveyor to supply toner to the development section 11*a* and an agitator 12 as a stirrer to stir the toner in the hopper 11*b* are disposed in the hopper 11*b*. Additionally, an opening through which to fill the hopper 11*b* with toner is disposed in the side wall of the hopper 11*b* on one end in the axial direction of the hopper 11*b*, and a cap 11*a* closes the opening. The waste toner receptacle 13 is disposed above the hopper 11*b*, and the waste toner receptacle 13 closes an upper opening of the hopper 11*b*.

The agitator 12 includes an agitator shaft 12*b* having a rectangular cross section and a blade 12*a* attached to the agitator shaft 12*b*. The agitator 12 is driven to rotate in the direction indicated by arrow A in FIG. 2 (in the counterclockwise direction in FIG. 2) by a drive unit 90 to be described later. The agitator 12 transports toner toward the second conveying screw 9 while stirring the toner in the hopper 11*b*. The blade 12*a* of the agitator 12 is a resin sheet made of, for example, polyethylene terephthalate (PET) with a thickness of 0.1 mm or more. Thus, the blade 12*a* is flexible. The agitator 12 rotates while the blade 12*a* is bent by contacting the inner wall of the hopper 11*b*.

A plurality of holes 121 are disposed in the blade 12*a*. This is because when the amount of toner in the hopper 11*b* is large, the blade 12*a* is greatly deformed against the weight of the toner and does not come into contact with the inner wall of the hopper 11*b*. As a result, the agitator 12 does not thoroughly stir the toner at the corner of the hopper 11*b*. Note that, depending on the type of toner and the shape of the hopper 11*b*, the plurality of holes 121 may not be necessary. Similarly, if the resin sheet is too thin, the blade 12*a* is greatly deformed against the weight of the toner and does not come into contact with the inner wall of the hopper 11*b*. As a result, the agitator 12 does not thoroughly stir the toner at the corner of the hopper 11*b*. Therefore, in the present embodiment, the thickness of the resin sheet is preferably 0.1 mm or more.

As illustrated in FIG. 4, the drive unit 90 that drives a plurality of rotators of the image forming unit 10 is disposed on the side face of the image forming unit 10 on the near side in FIG. 4. Covers 10*a* and 10*b* are attached to side faces facing each other in the axial direction of the image forming unit 10, respectively.

Figure 5:
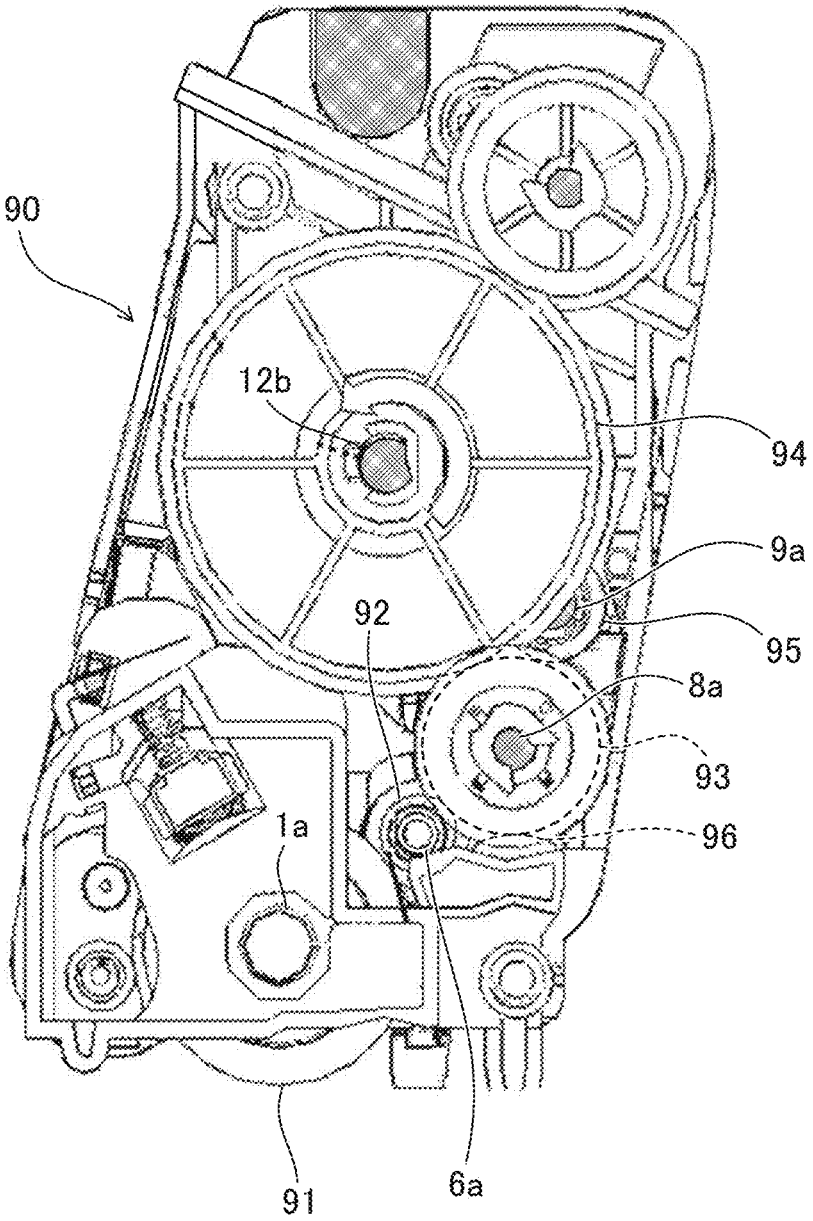
FIG. 5 is a schematic view of a drive unit of the image forming unit.

FIG. 5 is a schematic view of the drive unit 90 of the image forming unit 10.

As illustrated in FIG. 5, a development gear 92 disposed on a shaft 6*a* of the developing roller 6 meshes with a photoconductor flange gear 91 disposed on a flange to secure the photoconductor drum 1 to a drum shaft 1*a*. The development gear 92 meshes with a first screw gear 93 disposed on a shaft 8*a* of the first conveying screw 8. The first screw gear 93 has a certain width in the axial direction (see FIG. 4). An agitator gear 94 attached to an agitator shaft 12*b*, a second screw gear 95 attached to a shaft 9*a* of the second conveying screw 9, and a supply gear 96 attached to a shaft of the supply roller 7 mesh with the first screw gear 93.

Driving force of a drive motor is first transmitted to the photoconductor flange gear 91 to drive the photoconductor drum 1 to rotate. Then, the driving force is transmitted from the photoconductor flange gear 91 to the development gear 92 to drive the developing roller 6 to rotate. Subsequently, the driving force is transmitted from the development gear 92 to the first screw gear 93 to drive the first conveying screw 8 to rotate. Further, the driving force is transmitted from the first screw gear 93 to the second screw gear 95, the supply gear 96, and the agitator gear 94 to drive the second conveying screw 9, the agitator 12, and the supply roller 7 to rotate.

Figure 6:
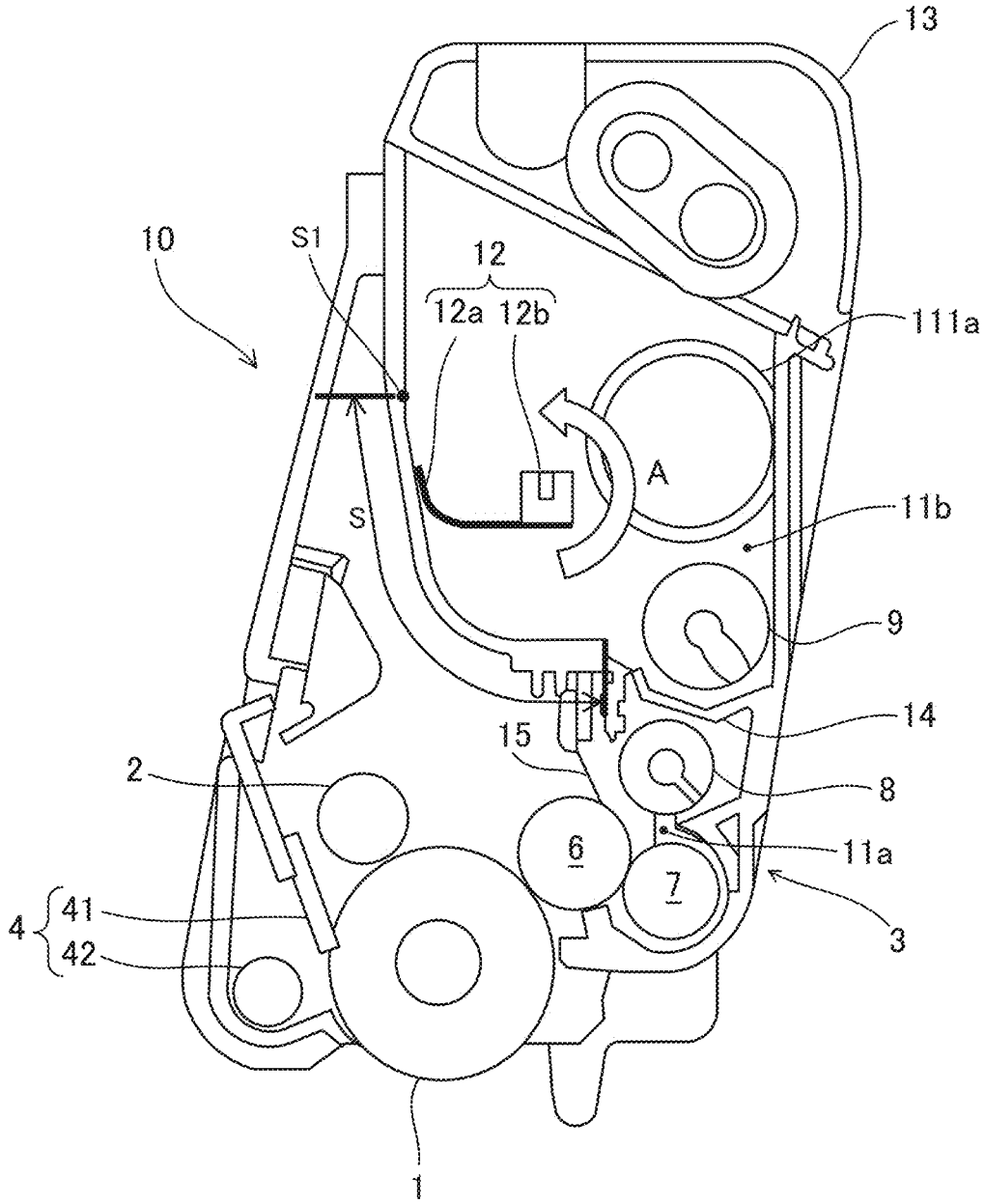
FIG. 6 is a cross-sectional view illustrating a state in which a tip of a blade slides while being bent along an inner wall surface of a hopper in the image forming unit.
Figure 7A:
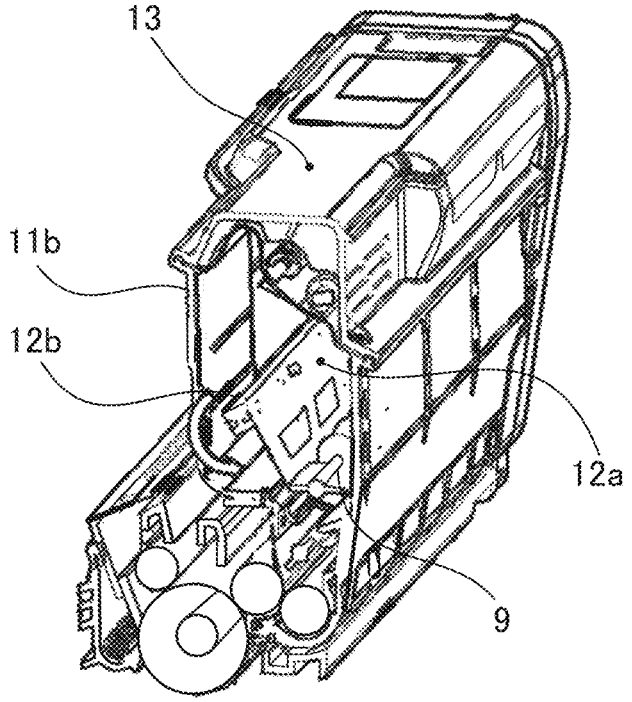
FIG. 7A is a cross-sectional perspective view illustrating a state in which the tip of the blade contacts a second conveying screw in the image forming unit.
Figure 7B:
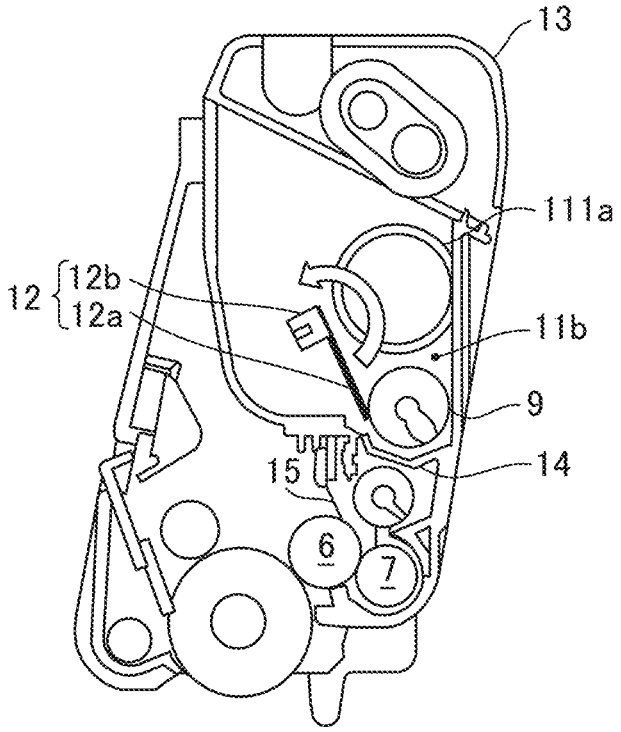
FIG. 7B is a cross-sectional view illustrating a state in which the tip of the blade contacts the second conveying screw in the image forming unit.
Figure 8:
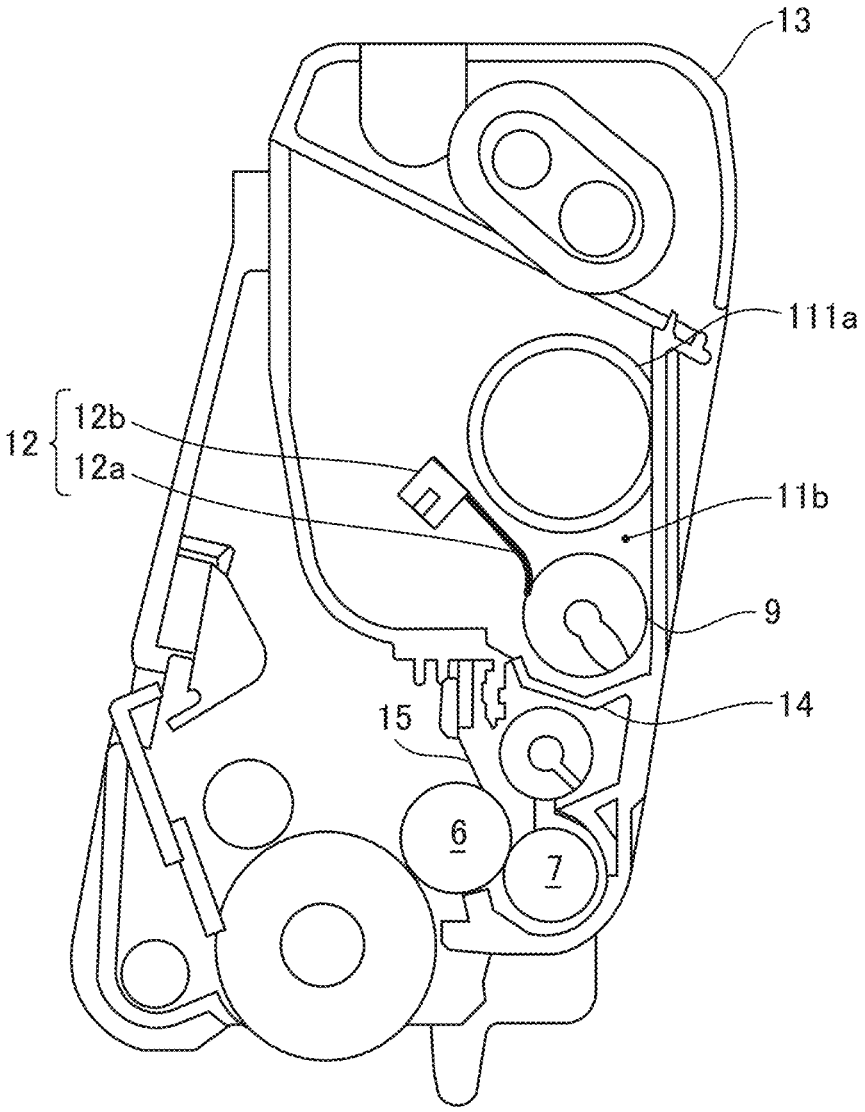
FIG. 8 is a cross-sectional view illustrating a state in which the tip of the blade slides along e second conveying screw while being bent.

FIGS. 6 to 8 illustrate states in which the agitator 12 rotates.

As illustrated in FIG. 2, as the agitator 12 rotates from the state in which the tip of the blade 12*a* of the agitator 12 is in contact with the inner wall of the hopper 11*b*, the blade 12*a* of the agitator on the tip side is bent while sliding along the inner wall of the hopper 11*b*. The blade 12*a* of the agitator 12 slides along the inner wall of the hopper 11*b* within the range S in FIG. 6. The range S is from the position S1 where the tip of the blade 12*a* first contacts the inner wall of the hopper 11*b* as illustrated in FIG. 2 to the end of the inner wall opposite the second conveying screw 9.

The agitator 12 rotates while the blade 12*a* slidingly contacts the inner wall of the hopper 11*b* within the range S. Accordingly, the agitator 12 transports toner in the hopper 11*b* toward the second conveying screw 9 while stirring the toner in the hopper 11*b*.

After the blade 12*a* reaches the downstream end of the range S in the direction of rotation of the agitator 12, the tip of the blade 12*a* comes into contact with the end face of the helical blade of the second conveying screw 9 as illustrated in FIGS. 7A and 7B. Then, as the agitator 12 further rotates from the state illustrated in FIGS. 7A and 7B, the blade 12*a* of the agitator 12 slides along the end face of the second conveying screw 9 while being bent as illustrated in FIG. 8.

In the present embodiment, the second screw gear 95 disposed on the shaft 9*a* of the second conveying screw 9 and the agitator gear 94 disposed on the agitator shaft 12*b* mesh with the first screw gear 93, and the agitator 12 and the second conveying screw 9 rotate in the same direction. Therefore, in the range in which the blade 12*a* of the agitator 12 slides along the second conveying screw 9, the tip of the blade 12*a* moves against the second conveying screw 9, and the blade 12*a* moves while sliding along the end face of the second conveying screw 9.

Figure 9:
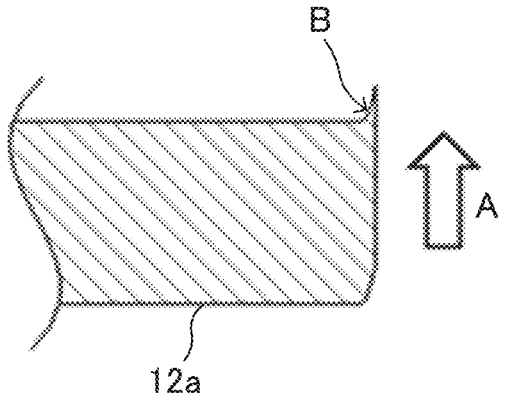
FIG. 9 is a schematic view illustrating an example of the tip of the blade.

As described above, the blade 12*a* of the agitator 12 slides along the inner wall of the hopper 11*b* and the second conveying screw 9. At that time, a noisy sliding sound is generated because, when the blade 12*a* of the agitator 12 is punched out from a sheet of PET sheet, burrs as illustrated in FIG. 9 may be formed. When the burrs contact the inner wall of the hopper 11*b* or the second conveying screw 9, a large sliding sound may be generated.

Figure 10:
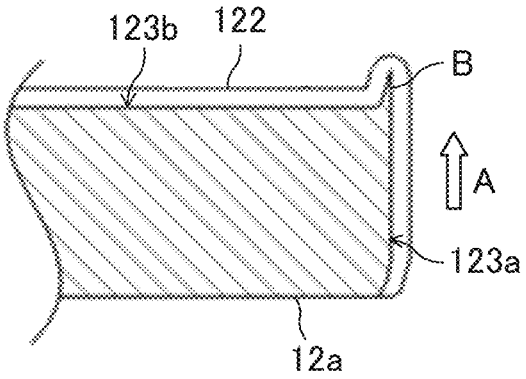
FIG. 10 is a schematic view illustrating the tip of the blade coated with a coating layer.

Therefore, in the present embodiment, as illustrated in FIG. 10, a coating layer 122 is disposed on a contact portion of the agitator 12 that contacts the inner wall of the hopper 11*b* and the second conveying screw 9. The arithmetic average roughness Ra of the coating layer 122 is 0.01 to 1.0 μm based on Japanese Industrial Standards (JIS) B0601 (2001). If the arithmetic average roughness Ra of the coating layer 122 is 1.0 μm or less, frictional resistance and vibration during sliding are reduced, and the coefficient of friction of the blade 12*a* against other components that the blades 12*a* contacts, such as the hopper 11*b*, the second conveying screw 9, or the like, is reduced. As a result, sliding sound can be minimized. In particular, the sliding sound due to surface roughness of the blade 12*a* and other components can be reduced. From the standpoint of noise reduction, the arithmetic average roughness Ra of the coating layer 122 is preferably 0.01 to 0.50 μm, more preferably 0.01 to 0.40 μm, and still more preferably 0.01 to 0.30 μm. Furthermore, the range of 0.01 to 0.25 μm is preferable, and the range of 0.01 to 0.20 μm is particularly preferable.

The arithmetic average roughness Ra of the coating layer 122 may be within the above-described range immediately after the coating layer 122 is formed by coating. Alternatively, after the coating layer 122 is formed, the arithmetic average roughness Ra of the coating layer 122 may become within the above-described range (particularly, a preferable range) by surface polishing or sliding against other components.

Further, the difference Δμ (i.e., μs-μd) between the coefficient of static friction μs of the coating layer 122 and the coefficient of dynamic friction μd of the coating layer 122 against other components (the inner wall of the hopper 11*b* and the second conveying screw 9) is preferably 0.12 or less. If the difference Δμ of the coefficient of friction is 0.12 or less, when the agitator 12 resume rotating after the agitator stops rotating in a state in which the blade 12*a* is in contact with the inner wall of the hopper 11*b* or the second conveying screw 9, the sticking and slipping phenomenon due to sliding of the blade 12*a* on other components can be minimized. As a result, noise (chattering of the blade 12*a*) due to sticking and slipping can be minimized.

The coating layer 122 preferably has a thickness (film thickness) of 50 μm or less. If the coating layer 122 has a thickness of 50 μm or less, the flexibility of the blade 12*a* is not inhibited, and sliding resistance against the inner wall of the hopper 11*b* and the second conveying screw 9 does not increase. Thus, the increase in the torque to drive the agitator 12 to rotate can be minimized. In addition, the coating layer 122 preferably has a thickness of 20 μm or more. If the coating layer 122 has a thickness of 20 μm or more, the coating layer 122 can reliably function to reduce the surface roughness of the blade 12*a*.

In the present embodiment, as illustrated in FIG. 10, the coating layer 122 is formed on a tip surface 123*a* of the blade 12*a* and a portion of a surface 123*b* of the blade 12*a* adjacent to the tip surface 123*a* on the downstream side in the direction of rotation of the agitator 12 indicated by arrow A in FIG. 10. Further, the coating layer 122 as illustrated in FIG. 10 can cover the burr B at the tip of the blade 12*a*. Covering the burr B with the coating layer 122 can improve the slidability, and minimize the sharpness of the burr B. As a result, when the blade 12*a* slides along other components (the inner wall of the hopper 11*b* and the second conveying screw 9), the burr B is not caught on other components. Thus, this configuration can minimize sliding resistance and vibration of the blade 12*a* and reduce sliding sound. Note that, the coating layer 122 in FIG. 10 is an example, and the coating layer 122 should be provided at least in the contact portion of the blade 12*a* that contacts other components.

Figure 11A:
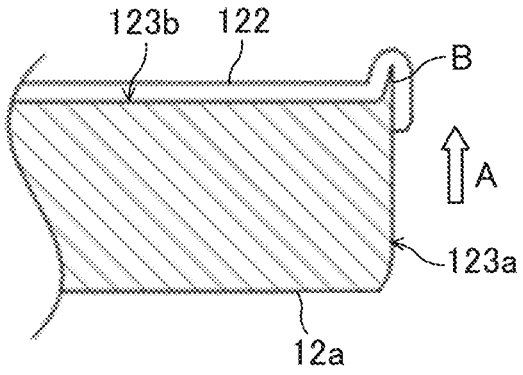
FIGS. 11A and 11B are schematic views illustrating other examples of the coating layer.

For example, as illustrated in FIG. 11A, a part of the tip surface 123*a* of the blade 12*a* on the downstream side in the direction of rotation of the agitator 12 indicated by arrow A in FIG. 11A and the portion of the surface 123*b* of the blade 12*a* adjacent to the tip surface 123*a* on the downstream side in the direction of rotation of the agitator 12. Even with such a configuration, the contact portion of the blade 12*a* that contacts other components and the burr B can be covered with the coating layer 122.

Figure 11B:
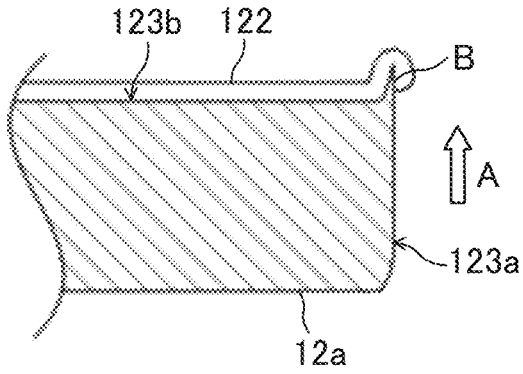

Further, as illustrated in FIG. 11B, only the portion of the surface 123*b* of the blade 12*a* adjacent to the tip surface 123*a* on the downstream side in the direction of rotation of the agitator 12 and the burr B may be covered with the coating layer 122.

Figure 12A:
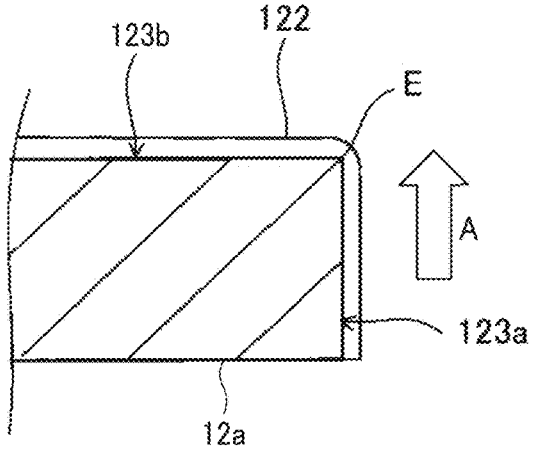
FIGS. 12A to 12C are schematic views illustrating examples of the coating layer of the blade without a burr at the tip.
Figure 12B:
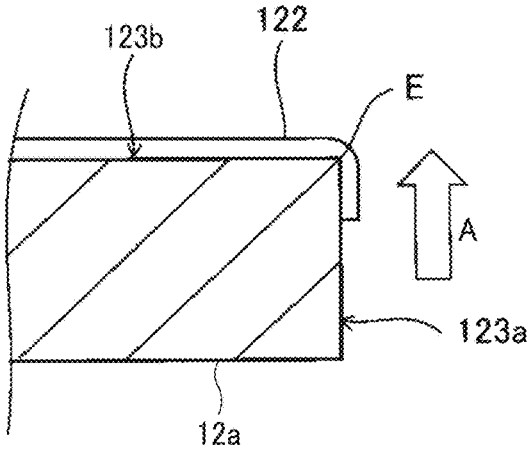
Figure 12C:
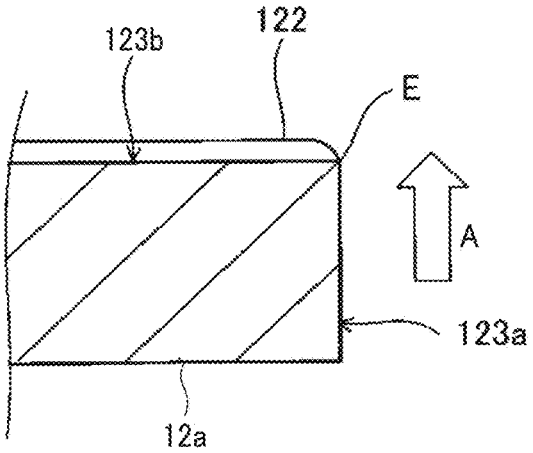

FIGS. 12A to 12C illustrate examples of the coating layer 122 of the blade 12*a* without a burr at the tip. FIG. 12A illustrates an example of the coating layer 122 formed on the tip surface 123*a* of the blade 12*a* and the portion of the surface 123*b* of the blade 12*a* adjacent to the tip surface 123*a* on the downstream side in the direction of rotation of the agitator 12 (i.e., the vicinity of the contact part with other components). FIG. 12B illustrates an example of the coating layer 122 formed on the part of the tip surface 123*a* of the blade 12*a* on the downstream side and the portion of the surface 123*b* of the blade 12*a* adjacent to the tip surface 123*a* on the downstream side in the direction of rotation of the agitator 12 FIG. 12C is an example of the coating layer 122 formed only on the portion of the surface 123*b* of the blade 12*a* adjacent to the tip surface 123*a* on the downstream side in the direction of rotation of the agitator 12.

In the present embodiment, a coating liquid is applied to the blade 12*a* to form a coating layer 122. As illustrated in FIGS. 12A and 12B, a portion of the coating layer 122 that covers an edge E of the blade 12*a* (i.e., the ridge between the tip surface 123*a* and the surface 123*b* on the downstream side in the direction of rotation of the agitator 12) becomes round due to surface tension. Such a configuration can prevent the blade 12*a* from being caught on other components (the inner wall of the hopper 11*b* and the second conveying screw 9) as compared with when the sharp edge E slides along the other components. As a result, sliding noise can be minimized.

Further, since the coating layer 122 can reduce the surface roughness, the coating layer 122 may be formed on the entire blade 12*a*, thereby preventing toner from adhering to the blade 12*a*.

Further, the coating layer 122 preferably is not transferred to the inner wall of the hopper 11*b* or the second conveying screw 9 on which the blade 12*a* slides. Thereby, the function of the coating layer 122 can be maintained over a long period of time, and the sliding noise can be reduced over a long period of time.

In the present embodiment, the coating layer 122 is formed on the blade 12*a* of the agitator 12. However, a coating layer may be formed on a contacted portion of the inner wall of the hopper 11*b* on which the blade 12*a* slides (i.e., the range S in FIG. 6) or a contacted portion of the second conveying screw 9 on which the blade 12*a* slides (i.e., end face of the helical blade). Even with this configuration, the sliding resistance against the blade 12*a* can be reduced, and the sliding sound can be minimized. Further, since the coating layer can reduce the surface roughness, the coating layer can prevent toner from adhering to the inner wall of the hopper 11*b* and the second conveying screw 9.

Alternatively, a coating layer may be formed on both of the contact portion of the blade 12*a* that contacts other components (the inner wall of the hopper 11*b* and the second conveying screw 9) and the contacted portion of other components by the blade 12*a*. The coating layer on both sides can reduce the surface roughness of both sides, and the sliding sound can be further minimized.

The coating layer includes at least a resin binder and a solid lubricant.

As the resin binder, a solvent-based resin or a water-based resin can be used without particular limitation, but a water-based emulsion type resin is preferably used. The resin binder forms a coating layer by curing and functions as a binder resin of solid particles. From the standpoint of noise reduction of the coating layer 122, a water-based emulsion type coating agent composition is preferable.

The resin binder is, but is not particularly limited to, one or more kinds of resin binders selected from a polyamide-imide resin, an epoxy resin, a silicone resin, a phenolic resin, a polyacrylic resin, a polyurethane resin, a polyolefin resin, or a modified product thereof, for example.

Further, the solid lubricant is not particularly limited, and one type of solid lubricant may be used, or two or more types of solid lubricants may be used in combination. Specifically, molybdenum disulfide, tungsten disulfide, calcium stearate, mica, graphite, polytetrafluoroethylene (PTFE), other lubricating resins, and complex oxides having an oxygen-deficient perovskite structure ($Sr_xCa_{1-x}CuO_y$, etc.) can be used.

Preferably, the solid lubricant includes: for example, fine particles of organic compound made of a fluorine resin (particularly, polytetrafluoroethylene, tetrafluoroethylene-hexafluoropropylene copolymer, etc.), a polyethylene resin, a polyamide resin, a polypropylene resin, a polyimide resin, a silicone resin; fine particles of inorganic compound such as molybdenum disulfide, graphite, silicon oxide, aluminum oxide, boron nitride, and zinc oxide; fine particles of metal such as lead; and a mixture thereof. In particular, at least one solid lubricant selected from a fluorine resin, a polyethylene resin, a polyamide resin, molybdenum disulfide, graphite, aluminum oxide, boron nitride, zinc oxide, titanium oxide, zirconium oxide, and mixtures thereof is preferably used. From the standpoint of noise reduction due to the coating layer 122, fine particles of inorganic compound, particularly molybdenum disulfide, graphite, silicon oxide, aluminum oxide, boron nitride, zinc oxide are preferable.

The average particle diameter of the solid lubricant is preferably 15 μm or less, and more preferably 0.2 to 10 μm. Here, the average particle diameter means a volume average particle diameter measured by a laser diffraction particle size distribution analyzer or a particle diameter observed by a scanning electron microscope.

The coating layer 122 may contain solid particles other than the solid lubricant. These solid particles are components that impart a desired function to the coating layer 122. The types of solid particles include, but is not particularly limited to, functional particles, such as reinforcing fillers, thickeners, antiwear agents, pigments, colorants, ultraviolet absorbers, thermal conductive fillers, conductive fillers, and insulating material. Note that, some particles can be blended as a plurality of functional particles.

The shapes of the solid lubricant and other solid particles are not particularly limited, and those having any shape such as a particle shape, a plate shape, a needle shape, and a fiber shape can be used. When the shape of the solid particles is anisotropic such as a plate shape, a needle shape, or a fiber shape, the aspect ratio of the solid particles can be 1.5 or more, 5 or more, or 10 or more.

The coating layer can be formed by any method such as spray coating, coating with a brush or a roller, impregnation coating, or the like. With a solvent-based resin or a water-based resin as the resin binder, the coating layer 122 can be formed by a relatively simple process of drying and curing after coating. Furthermore, since the coating layer 122 includes a solid lubricant, the coating layer 122 has lubricity, thereby reducing the coefficient of friction between the coating layer 122 and other components (the inner wall of the hopper 11*b* or the second conveying screw 9). As a result, sliding sound can be reduced.

Figure 13:
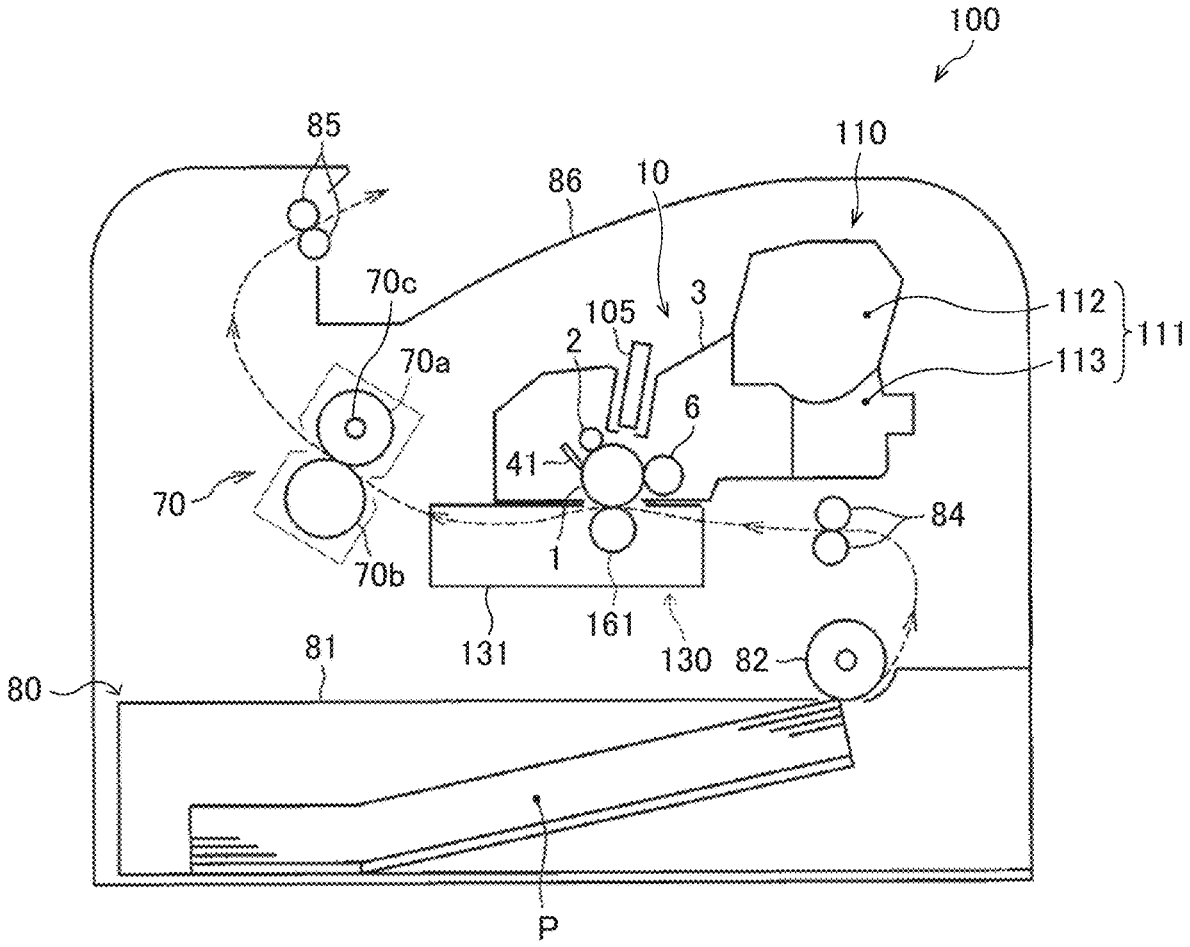
FIG. 13 is a schematic view of an image forming apparatus according to a second embodiment of the present disclosure.

FIG. 13 is a schematic view of an image forming apparatus 100 according to a second embodiment of the present disclosure.

The image forming apparatus 100 illustrated in FIG. 13 according to the second embodiment is a monochrome printer. An image forming unit 10 serving as a removable unit is removably installed in the image forming apparatus 100. Similarly to the first embodiment, the image forming unit 10 includes a photoconductor drum 1 serving as an image bearer to bear images thereon, a charging roller 2 serving as a charging device to charge the surface of the photoconductor drum 1, a developing device 3 to develop a latent image on the photoconductor drum 1 into a visible image, and a cleaning blade 41 as a cleaner to clean the surface of the photoconductor drum 1. The image forming unit 10 further includes a light-emitting diode (LED) head array 105 around the photoconductor drum 1. The LED head array 105 serves as an exposure device that exposes the surface of the photoconductor drum 1.

Additionally, a toner cartridge 110 serving as a developer container is detachably attached to the image forming unit 10. Inside a container body 111 of the toner cartridge 110, a developer chamber 112 is formed to contain toner as a developer to be supplied to a developing roller 6 of the developing device 3. The toner cartridge 110 further includes, as a part of the toner cartridge 110, a developer collection chamber 113 to collect (contain) the toner removed by the cleaning blade 41 (i.e., waste toner).

The image forming apparatus 100 further includes a sheet feeding device 80 to feed a sheet P, a transfer device 130 to transfer an image onto the sheet P, and a fixing device 70 to fix transferred image on the sheet P.

The transfer device 130 includes a transfer roller 161 as a transferor rotatable supported by a transfer frame 131. The transfer roller 161 contacts the photoconductor drum 1 in a state in which the image forming unit 10 is installed in the image forming apparatus 100, and an abutment part therebetween is called a transfer nip. Additionally, the transfer roller 161 is electrically connected to a power source and receives a predetermined amount of voltage that is either direct-current (DC) voltage, alternating current (AC) voltage, or both. The sheet feeding device 80 includes a sheet tray 81 to contain sheets P and a sheet feeding roller 82 to feed the sheets P. Downstream from the sheet feeding roller 82 in the direction in which the sheet P is transported, a registration roller pair 84 is disposed as a timing roller pair to transport the sheet P timely to the transfer nip. It is to be noted that "sheet P" used here includes, in addition to plain paper, thick paper, post cards, envelope, thin paper, coated paper, art paper, tracing paper, and the like. Additionally, overhead projector (OHP) transparency (OHP sheet or OHP film) may be used as the recording medium other than paper.

The fixing device 70 includes a fixing roller 70*a* and a pressure roller 70*b*. The fixing roller 70*a* is heated by an infrared heater 70*c* disposed inside the fixing roller 70*a*. The pressure roller 70*b* is pressed against the fixing roller 70*a*, and an abutment portion therebetween serves as a fixing nip.

An output roller pair 85 is disposed downstream from the fixing device 70 in the direction of conveyance of the sheet P. An upper face of the image forming apparatus 100 is partly recessed into an output tray 86, and the sheet P ejected by the output roller pair 85 is stacked on the output tray 86.

With reference to FIG. 13, basic operation of the image forming apparatus 100 according to the second embodiment is described below. When image formation starts, the photoconductor drum 1 of the image forming unit 10 is rotated clockwise in FIG. 13, and the charging roller 2 uniformly charges the surface of the photoconductor drum 1 in a predetermined polarity. Then, the LED head array 105 directs a light beam onto the charged surfaces of the photoconductor drum 1 based on image data input from an external device. Thus, an electrostatic latent image is formed on the photoconductor drum 1.

The electrostatic latent image formed on the photoconductor drum 1 is developed into a toner image (a visible image) with toner supplied by the developing device 3.

As image formation starts, the transfer roller 161 is rotated, and the predetermined voltage, which is either DC voltage, AC voltage, or both, is applied to the transfer roller 161, thus forming a transfer electrical field between the transfer roller 161 and the photoconductor drum 1.

In the sheet feeding device 80 disposed at the bottom portion of the image forming apparatus 100, the sheet feeding roller 82 starts rotating and the sheet P is fed out from the sheet tray 81. Then, the registration roller pair 84 stops the sheet P temporarily.

The registration roller pair 84 starts rotating at a predetermined timing to transport the sheet P to the transfer nip, timed to coincide with the arrival of the toner image on the photoconductor drum 1. The toner image on the photoconductor drum 1 is transferred onto the sheet P by the effect of the transfer electric field. After the transfer process, the cleaning blade 41 removes residual toner remaining on the photoconductor drum 1, and the removed toner is transported to and collected in the developer collection chamber 113.

Subsequently, the sheet P carrying the toner image is transported to the fixing device 70, and the fixing device 70 fixes the toner image on the sheet P. Then, the sheet P is ejected by the output roller pair 85 and stacked on the output tray 86.

Figure 14:
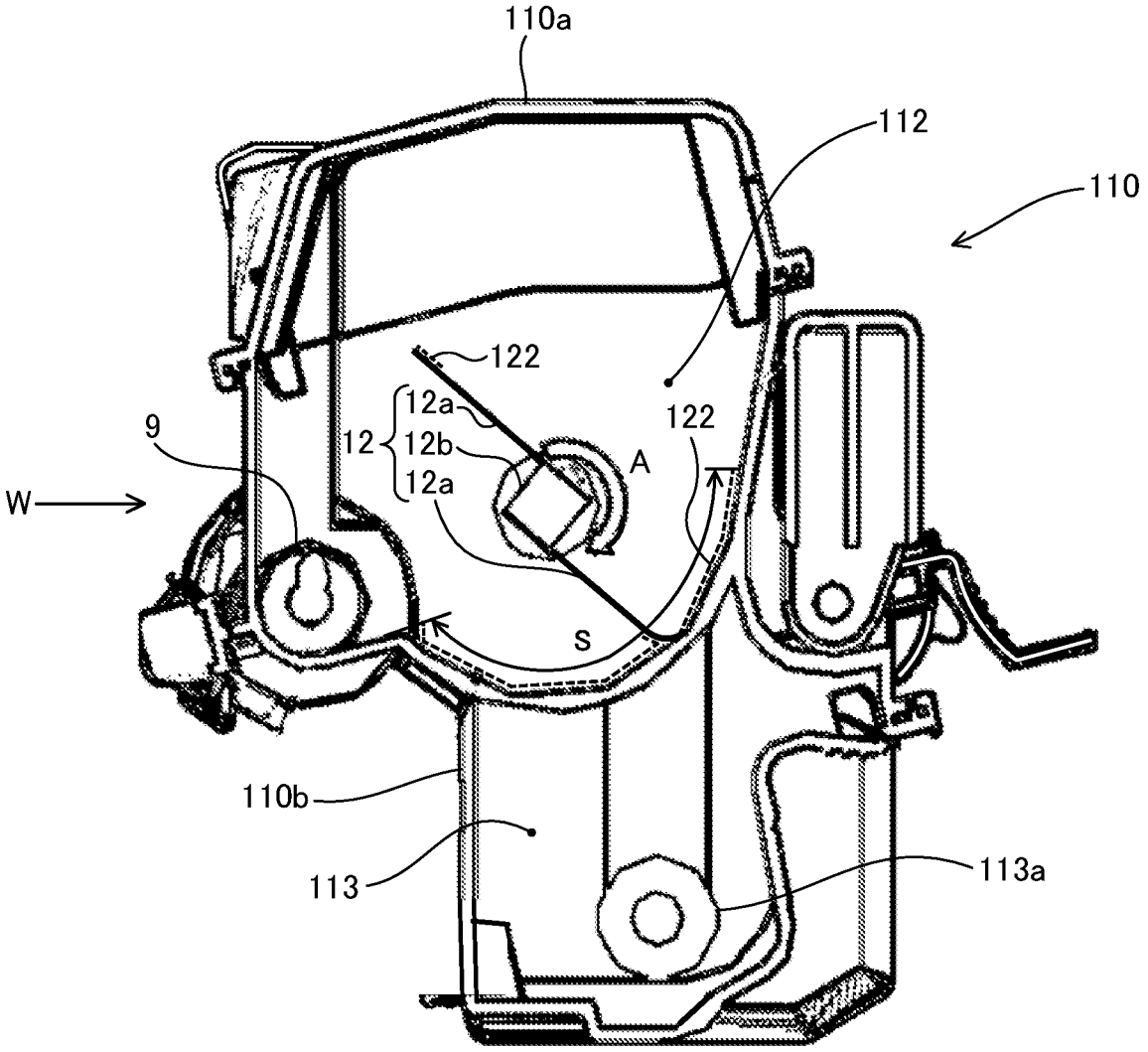
FIG. 14 is a cross-sectional view of a toner cartridge of the image forming apparatus in FIG. 13.
Figure 15:
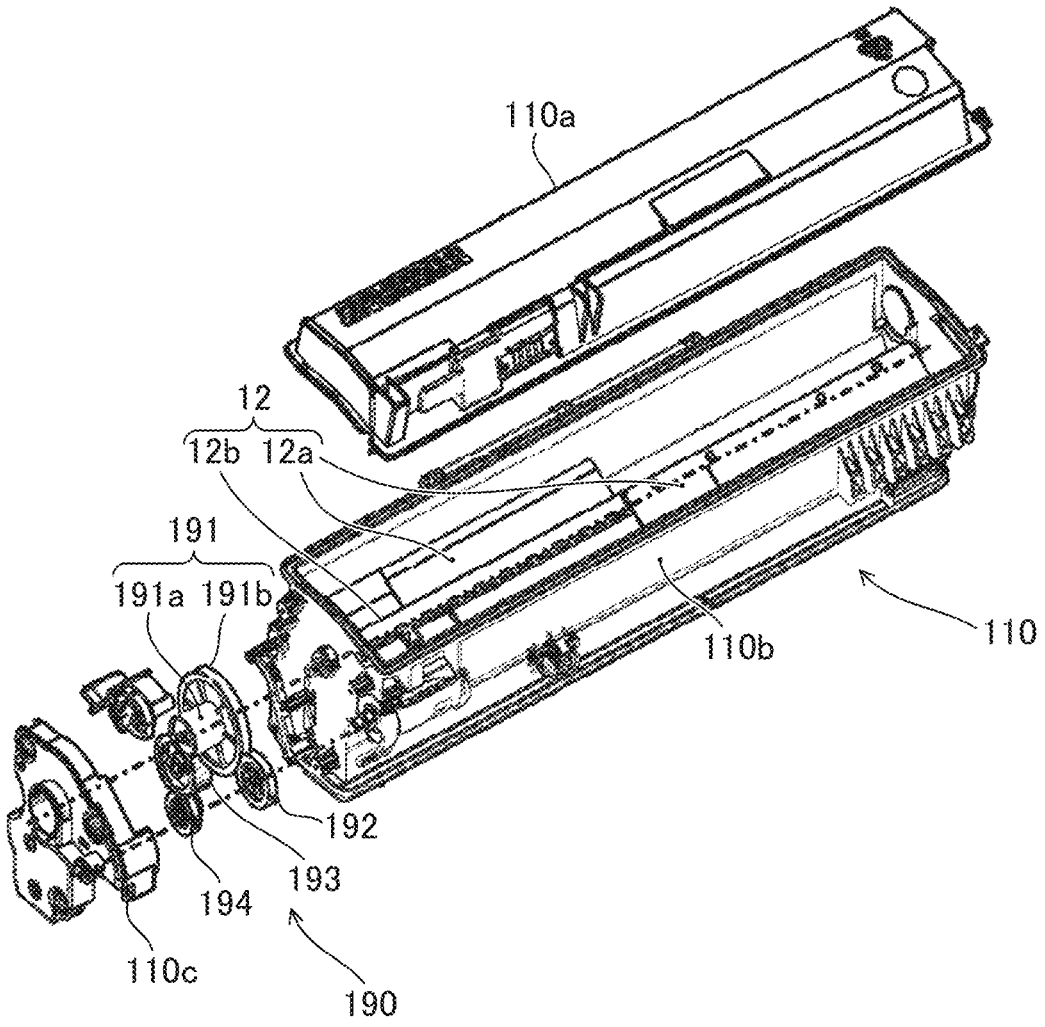
FIG. 15 is an exploded perspective view of the toner cartridge as viewed in the direction indicated by arrow W in FIG. 14.

FIG. 14 is a cross-sectional view of the toner cartridge 110, and FIG. 15 is an exploded perspective view of the toner cartridge 110 as viewed in the direction indicated by arrow W in FIG. 14.

As illustrated in FIG. 15, the toner cartridge 110 includes an upper case 110*a*, a lower case 110*b*, and a side cover 110*c*. The developer collection chamber 113 is formed by the lower case 110*b*, and the developer chamber 112 is formed by the upper case 110*a* and the lower case 110*b*.

Similarly to the hopper 11*b* described in the first embodiment, the developer chamber 112 includes an agitator 12 and a second conveying screw 9 that conveys toner to the developing device 3. The agitator 12 according to the second embodiment has two blades 12*a* attached to an agitator shaft 12*b* spaced apart by 180 degrees in the direction of rotation of the agitator 12. One blade 12*a* is disposed on one side with respect to a center of the agitator shaft 12*b* in the axial direction, and the other blade 12*a* is disposed on the other side with respect to the center of the agitator shaft 12*b* in the axial direction. The developer collection chamber 113 includes a conveying screw 113*a* to transport toner removed by the cleaning blade 41 into the developer collection chamber 113.

The blade 12*a* of the agitator 12 according to the second embodiment is a resin sheet of PET having a thickness of 0.1 mm or more and flexible, similarly to the first embodiment.

A drive unit 190 that transmits driving force of a driving motor to the agitator 12 and the second conveying screw 9 is disposed on one side face of the toner cartridge 110. The drive unit 190 has a first drive transmission 191 secured to the agitator shaft 12*b*. The first drive transmission 191 includes an input gear 191*a* and an output gear 191*b*. The input gear 191*a* penetrates the side cover 110*c* and meshes with a drive gear provided in the body of the image forming apparatus 100. The driving force is transmitted from the drive motor to the drive gear. The output gear 191*b* meshes with a screw gear 192 attached to a shaft of the second conveying screw 9. The output gear 191*b* also meshes with an idler gear 193 that meshes with the conveying gear 194 secured to a shaft of the conveying screw 113*a*.

As illustrated in FIG. 14, the agitator 12 is driven to rotate in the direction indicated by arrow A (clockwise in FIG. 14). Then, the tip of the blade 12*a* of the agitator 12 comes into contact with the inner wall of the developer chamber 112 and slide on the inner wall while being bent within the range S. Accordingly, toner in the developer chamber 112 is stirred and transported toward the second conveying screw 9. After the blade 12*a* reaches a downstream end of the range S illustrated in FIG. 14 in the direction of rotation of the agitator 12, as the agitator 12 is further rotated, the blade 12*a* comes into contact with the end face of the helical blade of the second conveying screw 9 and slide on the end face of the helical blade while being bent.

Even in this configuration according to the second embodiment, a sliding sound is generated when the blade 12*a* of the agitator 12 slides along the inner wall of the developer chamber 112 or the second conveying screw 9, and the sliding sound is regarded as noise of the image forming apparatus 100. Therefore, in the second embodiment, a coating layer similar to the first embodiment is formed on at least one of a contact part of the blade 12*a* with the inner wall of the developer chamber 112 or the second conveying screw 9, a contacted part of the inner wall of the developer chamber 112 by the blade 12*a* (i.e., range S in FIG. 14), and a contacted part of the second conveying screw 9 by the blade 12*a* (i.e., the end face of the helical blade). This configuration minimizes the sliding sound, thereby reducing noise of the image forming apparatus. In addition, the coating layer reduce the surface roughness, thereby preventing toner from adhering to the blade 12*a*, the inner wall of the developer chamber 112, and the second conveying screw 9.

The first and second embodiments are examples, and the present disclosure can also be applied to a stirring device that stirs waste toner stored in a waste toner bottle. Further, the object stirred by the stirring device according to the present disclosure is not limited to toner, and the present disclosure can also be applied to a stirring device that stirs powder such as cement or wheat flour, or liquid.

According to the present disclosure, noise can be reduced. The embodiments described above are examples and can provide, for example, the following effects, respectively.

Aspect 1

A stirring device includes a stirrer such as the agitator 12 configured to stir a stirred object such as toner, at least another component of the stirring device (in the above-described embodiment, a container to contain the stirred object such as the hopper 11*b*, the developer chamber 112, and the like; a conveyor such as the second conveying screw 9 to transport the stirred object in the container), and a coating layer. The coating layer is disposed on at least one of a contact part of the stirrer that contacts the at least another component and a contacted part of the at least another component contacted by the stirrer.

According to Aspect 1, since the coating layer is disposed on at least one of the contact part of the stirrer that contacts the at least another component and the contacted part of the at least another component contacted by the stirrer, slidability between the at least another component and the stirrer can be improved. As a result, the sliding sound can be minimized.

Aspect 2

In the Aspect 1, the arithmetic average roughness Ra of the coating layer 122 based on JIS B0601 (2001) is 0.01 μm or more and 1.0 μm or less.

According to Aspect 2, as described in the above embodiments, the coefficient of friction of the contact part and the contacted part can be reduced, thereby minimizing the sliding sound. Moreover, the stirred object such as toner can be prevented from adhering to the contact part and the contacted part.

Aspect 3

In Aspect 1 or 2, a difference between a coefficient of dynamic friction of the coating layer 122 and a coefficient of static friction of the coating layer 122 is 0.12 or less.

According to Aspect 3, as described in the above embodiments, when the sliding between the contact part of the stirrer and the contacted part of the at least another component resumes after the stirrer stops in a state in which the contact part of the stirrer is in contact with the contacted part of the at least another component, the sticking and slipping phenomenon of the stirrer can be minimized, thereby inhibiting noise such as chattering of the stirrer.

Aspect 4

In any one of the Aspects 1 to 3, the coating layer 122 is made of a resin containing a solid lubricant.

According to Aspect 4, as described in the above embodiments, lubricity is imparted to the coating layer, and the coefficient of friction of the contact part and the contacted part can be reduced, thereby minimizing the sliding sound.

Aspect 5

In any one of the aspects 1 to 4, the coating layer 122 is not transferred to what the coating layer contacts.

According to Aspect 5, the function of the coating layer 122 can be maintained over a long period of time, thereby reducing the sliding sound over a long period of time.

Aspect 6

In any one of the Aspects 1 to 5, a thickness of the coating layer 122 is 50 μm or less.

According to Aspect 6, as described in the above embodiments, when the coating layer 122 is formed on the contact part of the stirrer, the flexibility of the contact part is not inhibited, thereby preventing contact pressure between the contact part and the contacted part from increasing. In addition, when the coating layer is formed on the contacted part such as the inner wall of the hopper 11*b*, the distance between the inner wall and the stirrer is reduced, and the contact pressure between the contact part and the contacted part is prevented from increasing.

Aspect 7

In any one of the Aspects 1 to 6, the thickness of the coating layer 122 is 20 μm or more.

According to Aspect 7, as described in the above embodiments, the effect of the coating layer 122 is reliably exerted.

Aspect 8

In any one of Aspects 1 to 7, the stirrer is a resin sheet.

According to Aspect 8, as described in the above embodiments, the stirrer slides along the contacted part such as the inner wall of the hopper 11*b* while being bent. As a result, the stirrer can reliably stir the stirred object such as toner in the hopper 11*b* while transporting the stirred object toward the second conveying screw 9.

Aspect 9

In Aspect 8, the resin sheet is a polyethylene terephthalate (PET) sheet.

According to Aspect 9, as described in the above embodiments, the stirrer can be a resin sheet having flexibility.

Aspect 10

In the Aspect 8 or 9, a thickness of the resin sheet is 0.1 mm or more.

According to Aspect 10, the resin sheet can be prevented from being greatly bent due to the resistance of the stirred object such as toner. As a result, the contact part such as the tip of the resin sheet does not fail to contact the contacted part such as the inner wall of the hopper 11*b*.

Aspect 11

In any one of Aspects 1 to 10, the at least another component is a container such as the hopper 11*b* configured to contain the stirred object such as toner.

According to Aspect 11, sliding sound can be minimized when the stirrer slides along the inner wall of the container such as the hopper 11*b*.

Aspect 12

In any one of Aspects 1 to 11, the at least another component is a conveyor such as the second conveying screw 9 configured to transport the stirred object such as toner.

According to Aspect 12, sliding sound can be minimized when the stirrer slides along the conveyor such as the second conveying screw 9.

Aspect 13

In any one of Aspects 1 to 12, the stirred object is toner.

According to Aspect 13, aggregation of toner can be minimized, and the noise when toner is stirred can be minimized.

Aspect 14

A toner container such as the hopper 11*b* or a toner cartridge includes a chamber configured to contain toner, and the stirring device according to any one of Aspects 1 to 13 configured to stir the toner in the chamber. The stirring device includes the stirrer such as the agitator 12 to stir the contained toner.

According to Aspect 14, the noise when the toner is stirred in the toner container can be minimized.

Aspect 15

A waste toner receptacle includes a chamber configured to contain waste toner, and the stirring device according to any one of Aspects 1 to 13 configured to stir the waste toner in the chamber.

According to Aspect 15, the noise when the waste toner is stirred in the waste toner receptacle can be minimized.

Aspect 16

An image forming apparatus such as the printer includes the stirring device according to Aspects 1 to 13.

According to Aspect 16, the noise of the image forming apparatus can be reduced.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A stirring device comprising:

a stirrer having a blade and a lubricating coating layer on the blade, the stirrer being configured to stir a stirred object; and at least another component of the stirring device; wherein the lubricating coating layer is disposed on a contact part of the blade that contacts the at least another component and a second lubricating coating layer on a contacted part of the at least another component contacted by the stirrer.

2. The stirring device according to claim 1, wherein arithmetic average roughness of the lubricating coating layer based on Japanese Industrial Standard B0601 (2001) is 0.01 μm or more and 1.0 μm or less.

3. The stirring device according to claim 1, wherein a difference between a coefficient of dynamic friction of the lubricating coating layer and a coefficient of static friction of the lubricating coating layer is 0.12 or less.

4. The stirring device according to claim 1, wherein the lubricating coating layer is made of a resin including a solid lubricant.

5. The stirring device according to claim 1, wherein the lubricating coating layer is not transferred to what the lubricating coating layer contacts.

6. The stirring device according to claim 1, wherein a thickness of the lubricating coating layer is 50 μm or less.

7. The stirring device according to claim 1, wherein a thickness of the lubricating coating layer is 20 μm or more.

8. The stirring device according to claim 1, wherein the stirrer is a resin sheet.

9. The stirring device according to claim 8, wherein the resin sheet is a polyethylene terephthalate sheet.

10. The stirring device according to claim 8, wherein a thickness of the resin sheet is 0.1 mm or more.

11. The stirring device according to claim 1, wherein the at least another component is a container configured to contain the stirred object.

12. The stirring device according to claim 1, wherein the at least another component is a conveyor configured to transport the stirred object.

13. The stirring device according to claim 1, wherein the stirred object is toner.

14. A toner container comprising:

a chamber configured to contain toner; and the stirring device according to claim 1 configured to stir the toner in the chamber.

15. A waste toner receptacle comprising:

a chamber configured to contain waste toner; and the stirring device according to claim 1 configured to stir the waste toner in the chamber.

16. An image forming apparatus comprising the stirring device according to claim 1.

17. The stirring device according to claim 1, wherein the lubricating coating layer is formed only on a tip surface of the stirrer and a portion of a surface of the stirrer adjacent to the tip surface on a downstream side in a direction of rotation of the stirrer.

* * * * *